US005616896A

United States Patent [19]

Kontturi et al.

[11] Patent Number: 5,616,896

[45] Date of Patent: Apr. 1, 1997

[54] PROCEDURE FOR CONTROLLING AN ELEVATOR GROUP

[75] Inventors: Risto Kontturi, Kiljava; Marja-Liisa Siikonen, Helsinki, both of Finland

[73] Assignee: Kone Oy, Helsinki, Finland

[21] Appl. No.: 334,122

[22] Filed: Nov. 4, 1994

[30] Foreign Application Priority Data

Nov. 11, 1993 [FI] Finland ..... 934993

[51] Int. Cl.[6] ..... B66B 1/42

[52] U.S. Cl. ..... 187/384; 187/382

[58] Field of Search ..... 187/382, 384, 187/387, 380, 392

[56] References Cited

U.S. PATENT DOCUMENTS

| | | | |
|---|---|---|---|
| 4,346,789 | 8/1982 | Ekholm . | |
| 4,411,337 | 10/1983 | Schröder et al. . | |
| 4,662,480 | 5/1987 | Polis et al. | 187/126 |
| 5,024,295 | 6/1991 | Thngavelu | 187/125 |
| 5,092,431 | 3/1992 | Schroder | 187/127 |
| 5,168,135 | 12/1992 | Kubo et al. | 187/127 |
| 5,229,559 | 7/1993 | Siikonen et al. . | |
| 5,304,752 | 4/1994 | Hayashi et al. | 187/126 |
| 5,305,198 | 4/1994 | Schroder et al. | 364/402 |
| 5,329,076 | 7/1994 | Kameli | 187/127 |
| 5,334,807 | 8/1994 | Kubo et al. | 187/126 |

FOREIGN PATENT DOCUMENTS

| | | |
|---|---|---|
| 0032000 | 7/1981 | European Pat. Off. . |
| 2110423 | 6/1983 | United Kingdom . |

*Primary Examiner*—Robert Nappi

[57] ABSTRACT

The invention relates to a procedure for controlling an elevator group. According to the invention, the landing calls issued from different floors are weighted by a floor-specific weight factor. The weighted call time is utilized in the calculation of the serving time of the calls and for the selection of the best elevator to serve a landing call.

13 Claims, 2 Drawing Sheets

PROCEDURE FOR CONTROLLING AN ELEVATOR GROUP

The present invention relates to a procedure for controlling an elevator group.

BACKGROUND OF THE INVENTION

In the control of the elevators in an elevator group, one objective is to ensure that customers are served in an optimal way in different traffic situations. A customer who presses an elevator call button should be served within a reasonable time both in peak-traffic conditions and during low-traffic hours. Various group control procedures are known which make use of traffic statistics for the control of the elevators or which involve monitoring of the waiting time of customers. A procedure used for group control, or more precisely speaking selection of traffic type in group control, is known from patent U.S. Pat. No. 5,229,559.

Previously known group control methods are not adaptable for situations in which the elevator users on a certain floor or certain floors are to be guaranteed a certain average or even above-average level of service. Especially during heavy traffic, e.g. upward and downward peak traffic, floors where the traffic is heavier than average may be ill served. This is because the number of people waiting behind the calls on each floor is generally not known.

SUMMARY OF THE INVENTION

The object of the present invention is to develop a group control method which allows individual weighting of each floor or group of floors in the control of the elevators.

The procedure of the invention enables the person responsible for the operation of the elevators in a building to define a floor-specific service profile. In peak-traffic situations, the waiting times for the floors selected and for the passengers coming from those floors will not be longer than the average value, and the waiting times are also shortened in certain traffic situations. The procedure is suited for use with different group control systems without requiring any other changes in the control.

BRIEF DESCRIPTION OF THE DRAWINGS

In the following, the invention is described by the aid of one of its embodiments by referring to the drawings, in which.

DETAILED DESCRIPTION OF THE PREFERRED EMBODIMENTS

Figure 1:
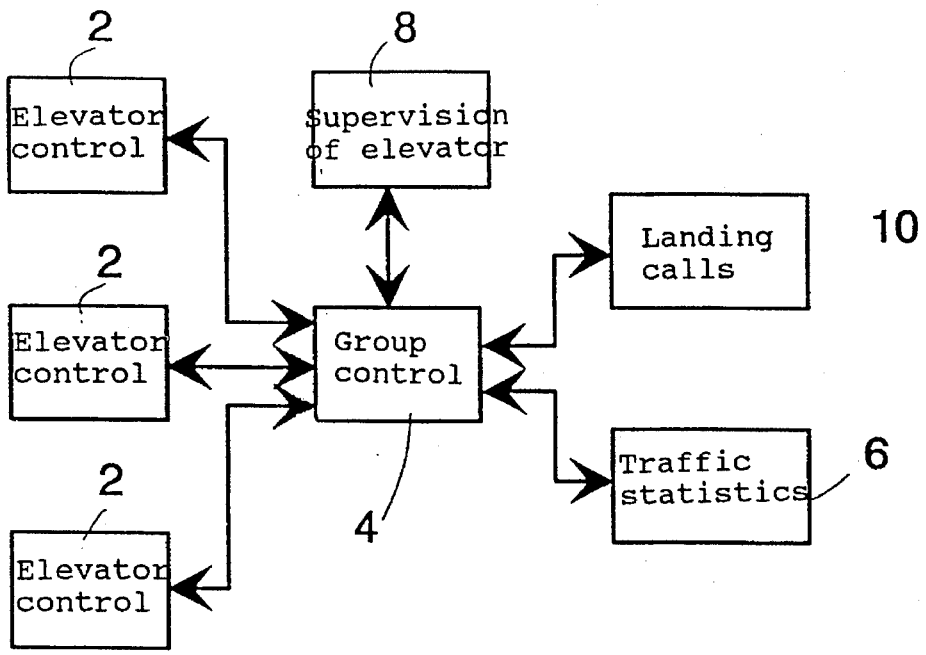
FIG. 1 presents a block diagram illustrating the control of an elevator group.

The diagram in FIG. 1 illustrates the structure of the control system of an elevator group. The landing calls entered via the call buttons on the various floors of the elevator system are transmitted to the group control unit or elevator control unit associated with the call button in question. The elevator control units 2 are connected to the group control unit 4, which, in the manner described below, handles the allocation of calls to given elevators. In the traffic statistics unit 6, the system accumulates short-term and long-term statistics about the actual traffic, and these are utilized in the group control. The supervision and regulation system 8 of the elevator is connected to the group control unit, to which it gives weighting signals as provided by the invention. The supervision and regulation system 8 may be placed in the machine room of the elevator, as are the elevator and group control units. It can also be placed in conjunction with the building supervision unit and it provides authorized persons the right to make changes in the system. The elevator control 2, group control 4 and supervision and regulation 8 units are preferably interlinked via a serial communication network. Correspondingly, the actuating elements 10 of the elevator, such as the call and signalling devices, are also connected to the elevator control unit via serial communcation links.

Figure 2:
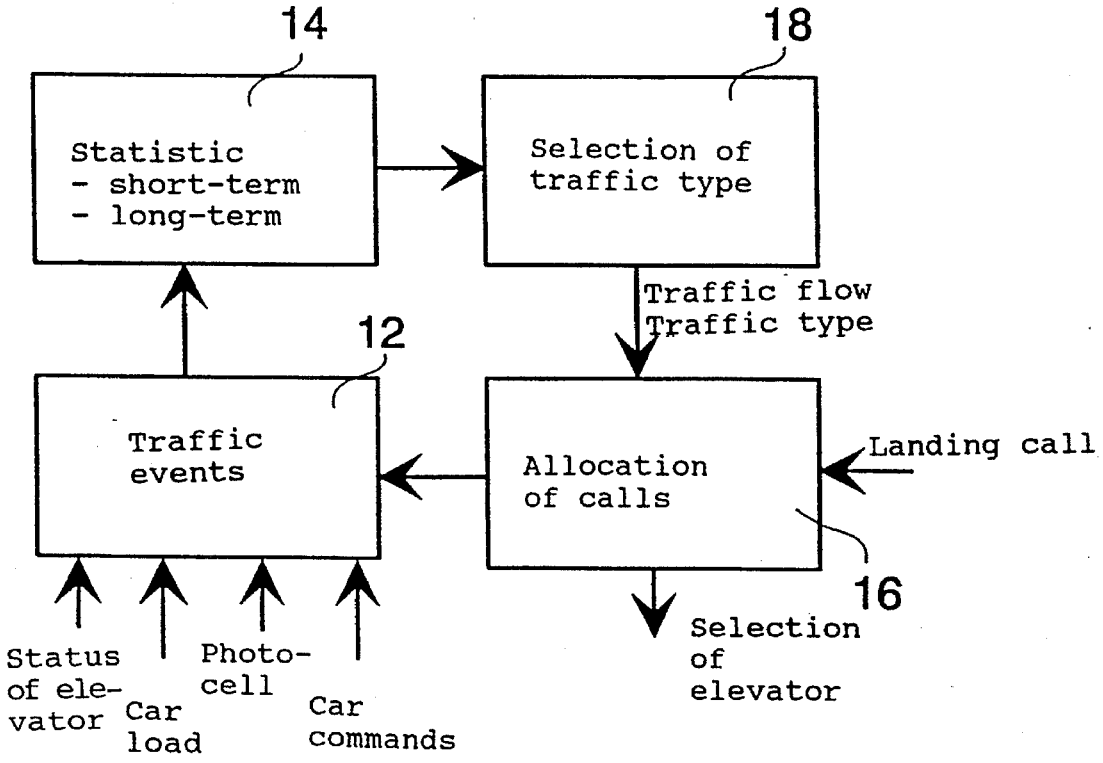
FIG. 2 presents a block diagram illustrating the principle of group control of an elevator.

In the following, a possible system for the distribution of calls between different elevators is described by the aid of FIG. 2. On the basis of statistical data (block 12) and real-time data (block 14), a traffic predictor in the group control unit determines the manner in which the elevator cars are to be dispatched to serve landing calls (block 16). The statistics are generated by determining the car load by means of a load-weighing device and photosensitive cells detecting the transitions of persons into and out of the car and by considering the car calls and landing calls issued. Long-term statistics are generated to determine e.g. the variations during a day, and short-term statistics e.g. to recognize the prevailing traffic situation, block 18. Based on the events relating to the operation of the elevator and on the statistics, a traffic type is formed e.g. in the manner described in U.S. Pat. No. 5,229,559. In each application, a desired number of traffic types, e.g. up-peak, down-peak, two-way traffic, inter-floor and mixed traffic, can be defined as required, depending on the size of the elevator group and the traffic volume. According to the traffic type, different call types, such as landing calls from the entrance floor, landing calls in the up-direction from intermediate floors and down-calls, are assigned a certain weight. These weight values define the relative importance of different landing calls within the traffic type selected. These weight values are determined according to the long-term statistics, the number of elevators belonging to the elevator group, the traffic volume and the use of the building. In an up-peak situation, calls issued from the entrance floor are given a weight value of e.g. 4 while calls from other floors have a weight value of 2. For smooth traffic and even other traffic types, the weight values can be the same for all floors.

According to the invention, landing calls issued from certain floors are assigned an extra weight factor $\lambda_f$ of by which the serving times relating to these floors are multiplied when the elevator cars are allocated to serve the calls. In a commercial building, e.g. the down-calls from a certain floor can be weighted due to the large number of customers visiting the premises on that floor and to the intense traffic involved. The cost function S(l,f) of the serving time is of the form $$S(l,f)=ETA(l)+\lambda_f * CT_f, \quad (1)$$

where

ETA(1)=estimated travel time of elevator 1 to floor f, $\lambda_f$=weight factor for floor f, and $CT_f$=call time of call issued from floor f.

The cost function may also be e.g. of the form $$S(l,f)=\lambda_f * (ETA(l)+CT_f), \quad (2)$$

in which case the floor-specific weight value has an effect on the predicted serving time.

Figure 3:
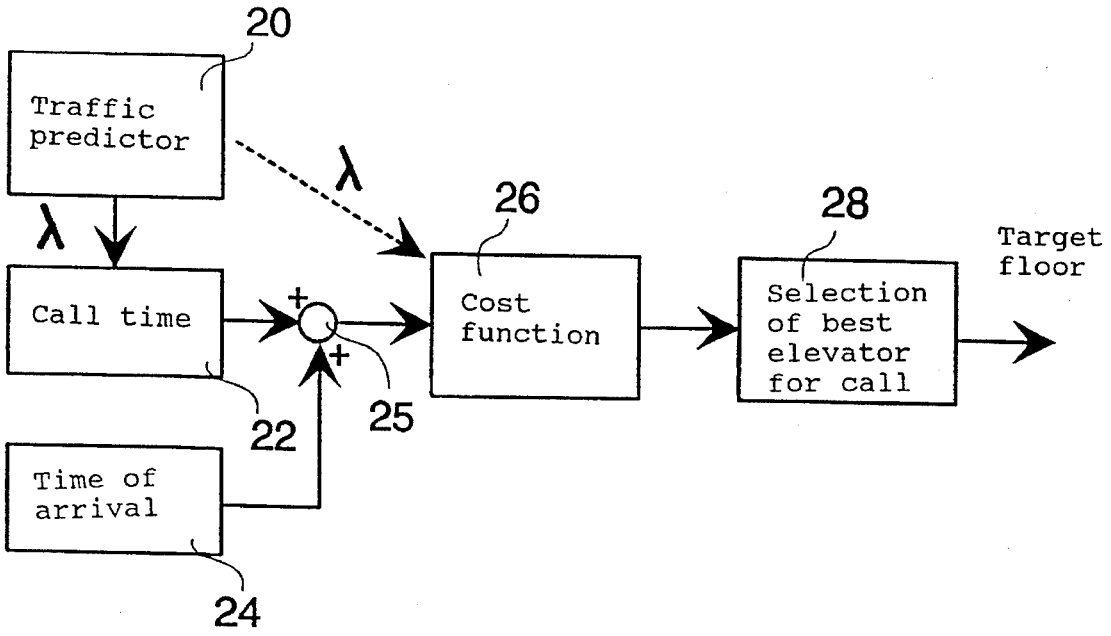
FIG. 3 illustrates the selection of an elevator by the method of the invention.

FIG. 3 illustrates the selection of the best elevator by using the cost function given in equation (1). The traffic predictor 20 produces a weight factor $\lambda_f$ for the floor. The call time $CT_f$ generated in block 22 is multiplied by the weight factor. The estimated time of arrival ETA obtained from block 24 is added to the weighted call time in block 25 and in this way a cost function is generated in block 26. In the elevator selection block 28, the best elevator is selected for each landing call in such a way that each call will be served in the best manner possible in the prevailing situation. For the selection, different elevators are considered in order to minimize the cost function and, based on this, the best elevator is selected. The broken line visualizes a procedure according to equation 2, in which the weight factor affects the predicted serving time.

The use of weight factors is preferably limited to certain times of the day or certain days of the week when the traffic intensity or other cause requiring a higher priority varies periodically. For instance, the open time or closing time of a restaurant or the time of use of a conference room may constitute such a situation. The weight factor for a floor is changed either permanently, for repeated periods, or for a certain time only. The weight factor is preferably determined by the person responsible for the functions of the building. The selection apparatus is placed in the supervision unit 8 of the elevator group and is thus connected to the group control unit 6 via a serial communication link.

The weight values determined on the basis of the traffic type given by the traffic predictor and the weight factors for different floors are applied to the serving time associated with each landing call in the calculation of the cost function and the allocation of elevator cars for different calls. This is performed in the allocation block in FIG. 2, where the target floors for the elevator cars are determined. During this estimation, an optimal allocation of target floors to different elevators is repeatedly calculated on the basis of the car load, car calls and landing calls for the elevators in the group and of data determined from these. In the case of landing calls, the evaluation is based on the call time, i.e. the time which has elapsed from the moment a given landing call was issued to the moment it is served. Another ground of evaluation is the passenger's waiting time, which means that the average waiting time for the passengers behind each landing call is determined.

When weighting according to the invention is employed, the method of allocation of calls may vary in the scope of known methods, and so can the group control methods.

Though the invention is described above by the aid of one of its embodiments, the presentation is not to be regarded as a restriction but the embodiments of the invention may be varied within the limits defined by the following claims.

We claim:

1. A method for controlling a group of at least two elevators in order to serve landing calls issued by call buttons mounted at landings, comprising the steps of:

(a) determining long-term traffic statistics for the elevator group, the traffic statistics indicating a level of demand for elevators at the landings;

(b) receiving a plurality of landing calls;

(c) defining a call-type weight value for each landing call received in said step (b) based upon the landing where the landing call was placed and the up-down direction indicated by the landing call;

(d) defining a floor-specific weight coefficient for each landing call received in said step (b) based upon the traffic statistics for the corresponding landing of each landing call;

(e) calculating a cost function for each of the landing calls received in said step (b), the cost function including at least an elevator-specific factor and a floor-specific factor, the factors being weighted by the call-type weight value and the floor-specific weight coefficient, the cost function for each landing call being calculated for each elevator in the elevator group, the call-type and floor-specific weight coefficients providing an adjustable weight factor profile for the landing calls by weighting the landing calls issued from at least one floor other than the entrance floor, and wherein the cost functions are for use in selecting an elevator to service a landing call received in said step (b).

2. The method according to claim 1, wherein the floor-specific weight coefficient defined in said step (c) corresponds to the intensity of passenger traffic on the floor.

3. The method according to claim 1, wherein the weight factor profile can be adjusted separately for each floor.

4. The method according to claim 1, wherein the order in which the calls are serviced is further determined on the basis of the time elapsed between the issuance of the landing call and the time that the landing call is served.

5. The method according to claim 1, wherein the cost function of said step (e) is further determined on the basis of a waiting time of passengers waiting behind a served landing call.

6. The method according to claim 1, wherein the floor-specific weight coefficients for a plurality of landings are permanently in force.

7. The method according to claim 1, wherein the floor-specific weight coefficients for a plurality of landings vary as a function of time.

8. A method for controlling a group of at least two elevators, the elevators servicing a plurality of landings and operating in response to landing calls, said method comprising the steps of:

(a) providing long-term elevator statistics indicating variations of passenger arrival/departure rates expected at respective landings at different times of day;

(b) receiving a plurality of landing calls;

(c) estimating a number of passengers waiting behind each of the landing calls based upon the statistics of said step (a);

(d) assigning a weight value to each existing landing call based upon the estimated number of waiting passengers from said step (c), the weight values indicating relative importance of the different types of landing calls;

(e) assigning an extra landing-specific weight coefficient to landing calls from certain landings;

(e) calculating an elevator cost function for each existing landing call using the assigned weight value and the assigned landing-specific weight coefficient, the elevator cost function being calculated for each elevator in the elevator group; and (f) controlling the elevators of the elevator group to service the existing landing calls based upon the cost functions calculated in said step (e).

9. The method of claim 8, further comprising the step of:

(g) if a new landing call is received, then repeating step (c) for the new landing call and repeating steps (d) through (f) for each existing landing call.

10. The method of claim 8, wherein the long-term statistics vary for different days of the week, and are based upon at least one of: detected loads in the elevators and a detected number of transitions of passengers entering and leaving the elevators.

11. The method of claim 8, wherein said step (c) estimates the number of waiting passengers by multiplying the passenger arrival/departure rate for the corresponding landing by an elapsed call time since the landing call was entered.

12. The method of claim 8, wherein the cost function includes:

$$S(i,f)=ETA(i)+(\lambda_f * CT_f),$$

where ETA(i) is the estimated time of arrival of an elevator, i, to floor f; $\lambda_f$ is the weight value for floor f; and $CT_f$ is an elapsed call time for a landing call issued from floor f.

13. The method of claim 8, wherein the cost function includes:

$$S(i,f)=\lambda_f * (ETA(i)+CT_f),$$

where ETA(i) is the estimated time of arrival of an elevator, i, to floor f; $\lambda_f$ is the weight value for floor f; and $CT_f$ is an elapsed call time for a landing call issued from floor f.

* * * * *